United States Patent [19]

Hartman et al.

[11] 4,197,984

[45] Apr. 15, 1980

[54] COMPOSITE ENVELOPE

[75] Inventors: Robert Hartman, Woodstock; Thomas E. Hopkins, Doraville; Robert P. Goldstein, Atlanta, all of Ga.

[73] Assignee: Dittler Brothers, Inc., Atlanta, Ga.

[21] Appl. No.: 953,552

[22] Filed: Oct. 23, 1978

[51] Int. Cl.[2] ..... B65D 27/06; B65D 33/14

[52] U.S. Cl. ..... 229/74; 40/310; 229/70; 229/73; 206/806

[58] Field of Search ..... 229/74, 68 R, 70, 73; 206/806; 40/310, 311

[56] References Cited

U.S. PATENT DOCUMENTS

| | | | |
|---|---|---|---|
| 1,157,432 | 10/1915 | Simpson et al. | 229/74 |
| 1,969,428 | 8/1934 | Schwartz | 229/74 |
| 1,984,559 | 12/1934 | Wilcox | 229/74 |
| 2,205,467 | 6/1940 | Cohen | 40/310 X |
| 2,954,154 | 9/1960 | Mouney | 229/70 |
| 3,184,150 | 5/1965 | Hubbard | 229/73 |
| 3,227,360 | 1/1966 | Krueger | 229/73 |
| 3,531,046 | 9/1970 | Carrigan | 229/73 X |

FOREIGN PATENT DOCUMENTS

| | | | |
|---|---|---|---|
| 2225000 | 10/1974 | France | 229/73 |
| 16699 | of 1892 | United Kingdom | 229/74 |

*Primary Examiner*—Stephen P. Garbe
*Attorney, Agent, or Firm*—Jones, Thomas & Askew

[57] ABSTRACT

A composite envelope prepared from a multiple panel blank which is folded twice in overlapping relationship to produce a tab portion and a detachable envelope portion. The panels are glued together to form the tab portion and the envelope portion, with a perforation line separating the two. The envelope includes a removable section and a flap containing remoistening glue for sealing the envelope.

4 Claims, 5 Drawing Figures

COMPOSITE ENVELOPE

BACKGROUND

This invention relates to a composite envelope for attachment to a bottled beverage. The envelope is pre-printed with the necessary information for conveying a message to a consumer. More specifically, the present invention relates to a composite envelope which is formed from a single rectangular sheet of paper material.

Pre-printed envelopes have been long used in conveying messages to consumers and in expediting the return of information or enclosures to persons or companies. Typical examples of such previous envelope structures are found in the following U.S. Pat. Nos.: 2,589,632; 2,678,769; 2,840,295; 2,877,944; 3,061,173; 1,529,381; 1,969,428; 1,984,559; 2,180,551; 1,114,920; 693,624; 3,713,673; 3,665,817; 3,784,185; 3,560,025; 2,255,087. While these structures have been useful, each has failed to meet the needs, recognized by applicant, for an envelope structure which could be secured to the neck of a bottled beverage and provide an effective advertisement of a product and an envelope and order blank for obtaining that product. It is recognized that some of these previous envelope structures did include openings so that the envelope could be placed around the neck of a bottle. However, no structure was provided for orienting the envelope structure in a generally vertical arrangement with respect to the bottle and no structure was provided for retaining the envelope flap and order blank in a closed arrangement while the composite envelope was in position on a bottled beverage. Other distinctive features for the present invention will become apparent from a review of other portions of this specification.

SUMMARY OF THE INVENTION

The present invention may be briefly described as comprising a single rectangular sheet of paper which is properly constructed by arranging an appropriate glue pattern on the paper, and folding the sheet of paper into three panels which overlap in a prescribed relationship. A perforation line is provided so that a tab section may be separated from an envelope section after the composite envelope is removed from a bottled beverage. The glue is applied in appropriate locations to give strength to the tab section, to form the envelope pocket and to hold the composite envelope in its folded state. The composite envelope may be provided with an opening in the tab section so that the tab section can be placed over the neck of a bottled beverage. By varying the size of the sheet of paper, and the relative positioning of fold lines and perforation lines, the size of the envelope and the amount of available advertising space can be easily modified.

It is an object of the present invention to provide a composite envelope with a detachable ready formed envelope.

Another object of the present invention is to provide a composite envelope which is easily and quickly produced with a minimum of production time, production cost and material waste.

Another object of the present invention is to provide a composite envelope which can be attached to the neck of a bottle by a removable tab section.

A further object of the present invention is to provide a composite envelope with a detachable tab which is capable of disposing an envelope section in a vertical arrangement adjacent a bottled beverage for effective display of advertising information.

Other objects, features and advantages of the present invention will become apparent from a review of the following specification, when taken in conjunction with the accompanying drawings.

DETAILED DESCRIPTION

Figure 1:
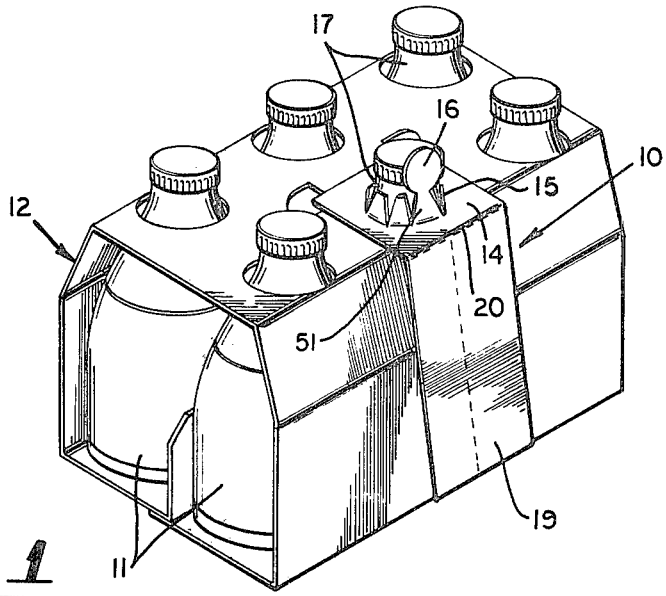
FIG. 1 is a perspective view of an embodiment of the composite envelope structure of the present invention displayed in position on a bottled beverage.
Figure 5:
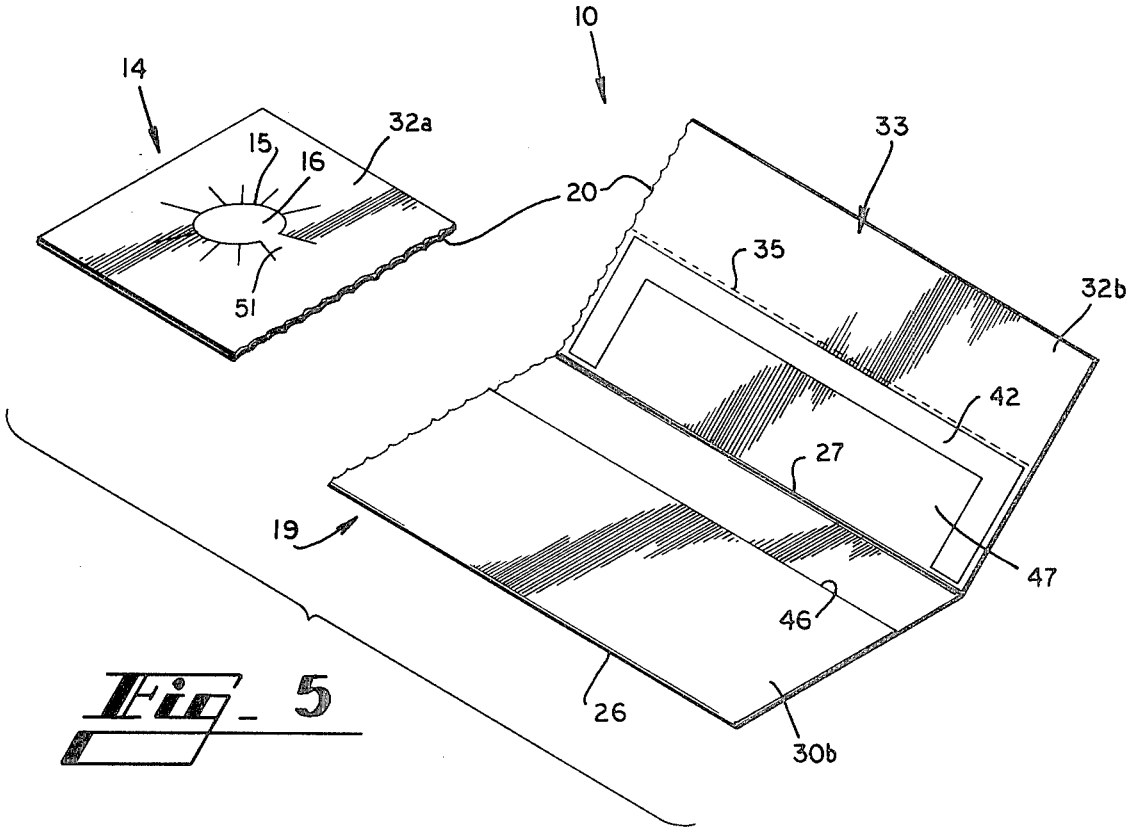
FIG. 5 is a pictorial view of the composite envelope structure of FIG. 1 in its completely folded state with the envelope portion detached from the tab portion.

Referring now in more detail to the drawings in which like numerals represent like components throughout the several views, FIG. 1 shows the composite envelope structure 10 of the present invention attached to a package 12 of soft drink bottles 11. The composite envelope structure 10 comprises an upper tab portion 14 including a punch-out tab or flap 16 which forms an opening 15 in tab portion 14. This opening is designed to receive the bottle cap and neck portion 17 of standard bottled beverages so that the composite envelope 10 may be retained by the bottle neck. The structure 10, further comprises a lower portion 19 which may be detached from upper tab portion 14 at perforation line 20. Perforation line 20 also provides a convenient line along which the composite envelope structure may be bent to display advertising information as shown in FIG. 1.

Figure 2:
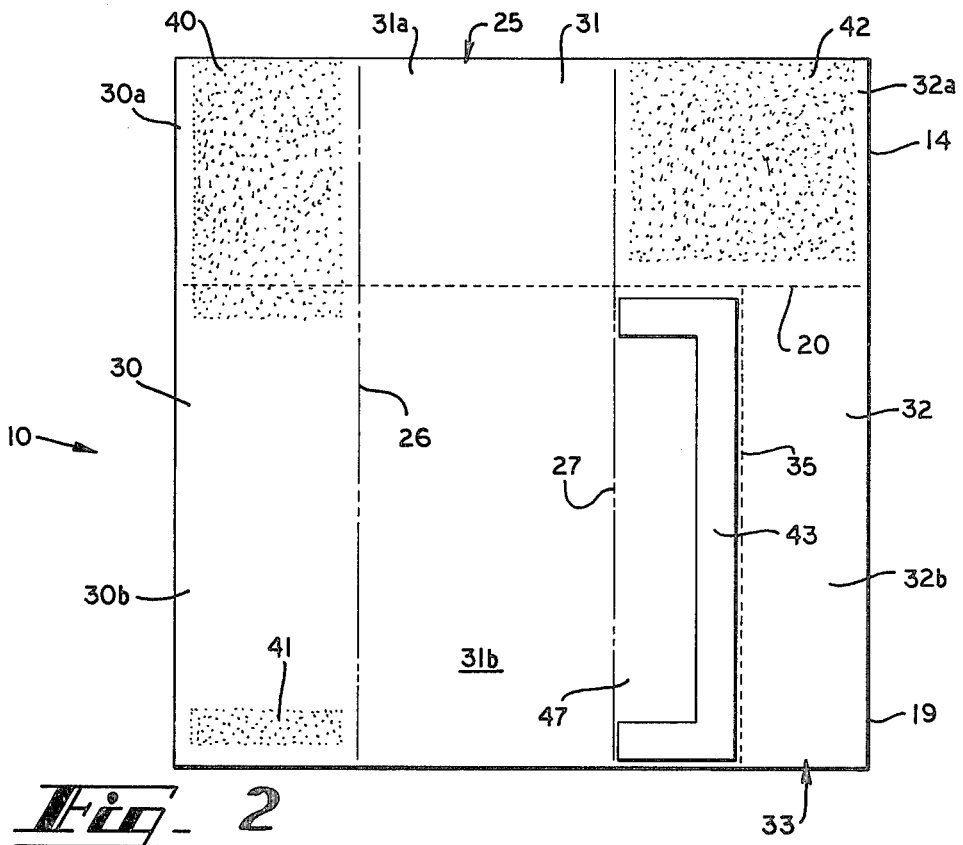
FIG. 2 is a plan view of the composite envelope structure of FIG. 1 in an unfolded state.
Figure 3:
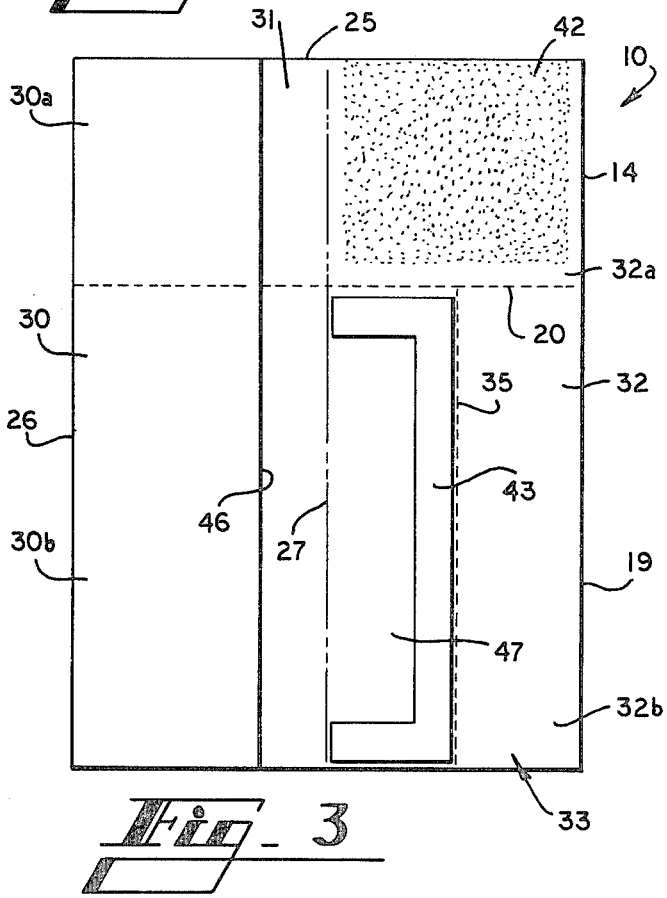
FIG. 3 is a plan view of the composite envelope structure of FIG. 1 in a partially folded state.
Figure 4:
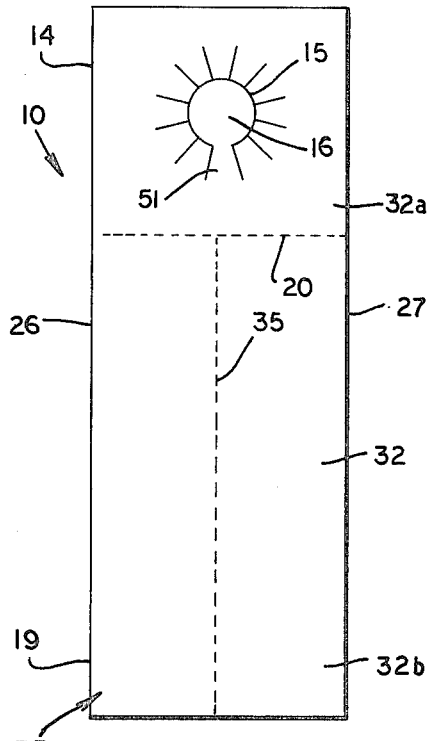
FIG. 4 is a plan view of the composite envelope structure of FIG. 1 in a completely folded state.

Referring now to FIGS. 2, 3 and 4, the structure 10 initially comprises a single rectangular sheet of paper 25. Two fold lines, 26 and 27, divide sheet 25 into three panels, a left panel 30, a center panel 31 and a right panel 32. The left panel 30 is slightly narrower than center panel 31 and right panel 32. With this arrangement left panel 30 will not completely cover center panel 31 when the left panel is folded over and glued to the center panel to form the basic envelope compartment. A first perforation line 20 is formed in the sheet of paper 25 perpendicular to the fold lines 26 and 27 to divide the sheet 25 into an upper portion 14 and detachable lower portion 19, thereby dividing the panels 30, 31 and 32 into upper and lower portions 30*a*, 30*b*, 31*a*, 31*b*, 32*a* and 32*b*. A second perforation line 35 is formed in the lower right panel portion 32*b* parallel to the fold line 27. This second perforation line 35, in combination with a portion of first perforation line 20, defines a removable section of the sheet of paper 33. This removable section may be used for display of printed information in the form of an order blank to be returned in the envelope.

A first quantity of glue 40 is applied in a rectangular pattern in the upper left panel portion 30*a* and this quantity of glue 40 extends partially into the lower left panel portion 30*b*. A second quantity of glue 41 is applied in a rectangular pattern to the lower left panel portion 30*b* at the lower edge of the panel. A third quantity of glue 42 is applied to the upper right panel portion 32*a* in a rectangular pattern. A quantity of remoistening glue 43 is adhered to and dried on the lower right panel portion 32*b* adjacent the second perforation line 35 and between the second perforation line 35 and fold line 27.

Assembly of composite envelope structure 10 for use as in FIG. 1 or for similar use, is as follows:

With the first and second quantities of glue, 40 and 41, still wet, the left panel 30 is folded along fold line 26 (see FIG. 3) so that the left panel overlies the center panel and is adhered thereto by glue 40 and 41. With this arrangement, the first section of upper tab portion 14 is formed and an envelope pocket 46 is formed between the two panels 30 and 31 in the lower portion 19 of the composite envelope structure. The right panel 32 is then folded, with the third quantity of glue 42 still wet, over the already folded panels 30 and 31 to be adhered thereto by glue 42. Remoistening glue 43 has been dried prior to assembly of the envelope and therefore is not tacky. The glue 42 adheres upper right panel portion 32*a* to upper center panel portion 31*a* and upper left panel portion 30*a*. The lower right panel portion 32*b* is not glued to other portions of the structure 10 but is retained in a closed position by the adhesion between the upper panel portions. Once the final fold has been made, a punch disc 16 is formed in the upper tab portion 14 by cutting through all three panels 30*a*, 31*a*, 32*a* (see FIG. 4) to create an opening 15 for placement over a bottle neck.

When finally folded and glued, the composite envelope structure 10 comprises an upper tab portion 14 which is both stiff and strong because all three of the upper panel portions 30*a*, 31*a*, and 32*a* are rigidly glued together, and a lower envelope portion 19 which is detachable from the tab portion 14 along the first perforation line 20. When tab portion 14 is removed from lower portion 19, an envelope pocket is created in portion 19 between glue section 41 and the remaining portion of glue section 40. In addition, panel 32*b* is freed by removal of the tab portion 14. Panel 32*b* includes an envelope sealing flap 47 and the removable section of paper 33. Removable section 33 may be separated from the sealing flap along perforation line 35. Sealing flap 47 includes the remoistening glue section 42. The remoistening glue is positioned so that when the sealing flap 47 is folded over the envelope pocket 46, the glue will engage left panel 30 and a portion of center panel 31.

The upper tab portion 14 of the composite structure serves to retain the entire structure in a closed arrangement prior to detachment of the lower envelope portion 19. In addition, the tab portion serves as additional advertising space and also as a mounting device as depicted in FIG. 1. The positioning of perforation line 20 on the flyer sheet 25 determines the relative size of the envelope 46 and the available advertising space on the upper tab portion 14. Likewise, the positioning of second perforation line 35 and the remoistening glue 42 on the lower right panel portion 32*b* determines the relative size of the removable section 33 and the sealing flap 47.

The disc 16 of the punch opening 15 is not discarded, but rather remains attached to the upper tab portion 14 by a stem 51 in order to eliminate the added production step of removing and disposing of the waste and to maximize the advertising space. That is, words or design can be printed on the disc 16 directly across what would otherwise be a hole at the opening 15.

Perforation line 20 also serves as a fold line between the top portion 14 and the envelope portion 19. by folding the structure at perforation line 20, it is possible for the envelope portion 19 to be positioned adjacent a bottled beverage, as shown in FIG. 1, and clearly display any printed information on the envelope portion.

While this invention has been described in specific detail with particular reference to a preferred embodiment thereof, it will be understood that variations and modifications can be effected within the spirit and scope of the invention as described hereinbefore and as defined in the appended claims.

What is claimed is:

1. A composite envelope structure, comprising:

a multiple panel blank;

at least two parallel fold lines dividing said blank into a left panel, a center panel, and right panel, for folding said left panel over said center panel along the first of said fold lines and for thereafter folding said right panel over said left panel folded over said center panel;

a line of perforations formed in said blank dividing said blank and each panel into an upper tab portion and a lower envelope portion detachably connected to said upper tab portion;

remoistening glue disposed on said envelope portion on said right panel;

glue disposed on said tab portion for fastening the tab portion of said left panel to the tab portion of said center panel and for fastening the tab portion of said right panel to at least the tab portion of said left panel;

glue disposed at the upper edge of said envelope portion of said left panel for fastening the upper edge of the envelope portion of said left panel to the upper edge of the envelope portion of said center panel;

glue disposed at the lower edge of said envelope portion of said left panel for fastening the lower edge of the envelope portion of said left panel to the lower edge of the envelope portion of said center panel with the lower edge of said right panel being free of glue except for said remoistening glue, so that said tab portions become folded on each other and adhered to each other to form a rigid tab, and said envelope portion becomes folded to form an envelope which is detachably connected to said rigid tab along said line of perforations and;

an opening formed through said rigid tab away from said line of perforations whereby the envelope structure is folded along said line of perforations, the opening inserted about an upwardly extending bottle neck or the like and the lower envelope portion hangs downwardly beside the bottle.

2. The envelope structure of claim 1 and wherein said opening is spaced from said line of perforations such that when said envelope structure is bent along said line of perforations said envelope portion hangs downwardly adjacent said bottle substantially parallel to the vertical axis of said bottle.

3. The envelope structure of claims 1 or 2 further comprising a punch-out flap aligned with said opening and connected by a stem to the remainder of said rigid tab, whereby said flap can be positioned covering said opening or pivoted away from said opening to accomodate said upwardly extending bottle neck or the like, said stem extending toward said opening from a portion of said rigid tab adjacent said envelope portion whereby said flap when pivoted away from said opening extends upwardly from said rigid tab to provide a flag.

4. Envelope structure of claim 1, further comprising a line of perforations formed in said envelope portion of said third panel parallel to said fold lines so as to define a removable section of said third panel, and wherein said remoistening glue is positioned between said line of perforations and said second fold line.

* * * * *